United States Patent [19]

Cooney

[11] Patent Number: 4,756,524

[45] Date of Patent: Jul. 12, 1988

[54] EXERCISE POLES

[76] Inventor: Kenneth B. Cooney, 11400 Osage Rd., Reno, Nev. 89506

[21] Appl. No.: 73,706

[22] Filed: Jul. 15, 1987

[51] Int. Cl.[4] ..... A63B 69/18; A63B 1/00; A63B 21/06

[52] U.S. Cl. ..... 272/97; 272/93; 272/70; 272/117; 135/75; 135/84; 273/81 A

[58] Field of Search ..... 272/93, 97, 117, 70, 272/118, 124; 135/65, 75, 76, 84; 280/819, 824; 273/81 A

[56] References Cited

U.S. PATENT DOCUMENTS

| | | | |
|---|---|---|---|
| 605,747 | 6/1898 | Sachs et al. | 272/117 |
| 1,696,462 | 12/1928 | Victor | 273/81 A |
| 3,690,655 | 9/1972 | Chapman | 272/117 X |
| 4,493,334 | 1/1985 | Semanchik et al. | 135/84 |
| 4,600,195 | 7/1986 | Hunter | 273/81 A |
| 4,664,373 | 5/1987 | Hait | 272/117 |
| 4,688,788 | 8/1987 | Olufs | 272/117 X |

FOREIGN PATENT DOCUMENTS

| | | | |
|---|---|---|---|
| 250815 | 4/1926 | United Kingdom | 273/81 A |

OTHER PUBLICATIONS

Consumer Report, Cross-Country Ski Exercisers, Nov. 1986, pp. 747-749.

Sierra Club catalog Spring, 1987, p. 3, Hiking Stick.

*Primary Examiner*—Richard J. Apley

*Assistant Examiner*—Franklin Gubernick

[57] ABSTRACT

A device, used in pairs, to provide upper body exercise to walkers, joggers and runners. A device which provides a total body exercise concept for said users. A device which emulates cross-country skiing during said use. A device which has a frame with a handgrip and foot thereon. The handgrip height can be adjusted as required. Weights can be added to the frame for a more balanced exercise routine of upward and downward force. The changeable foot is designed for ground and other supporting surface contact and provide for the rocking motion of the frame and to maintain good ground coefficient of friction.

9 Claims, 2 Drawing Sheets

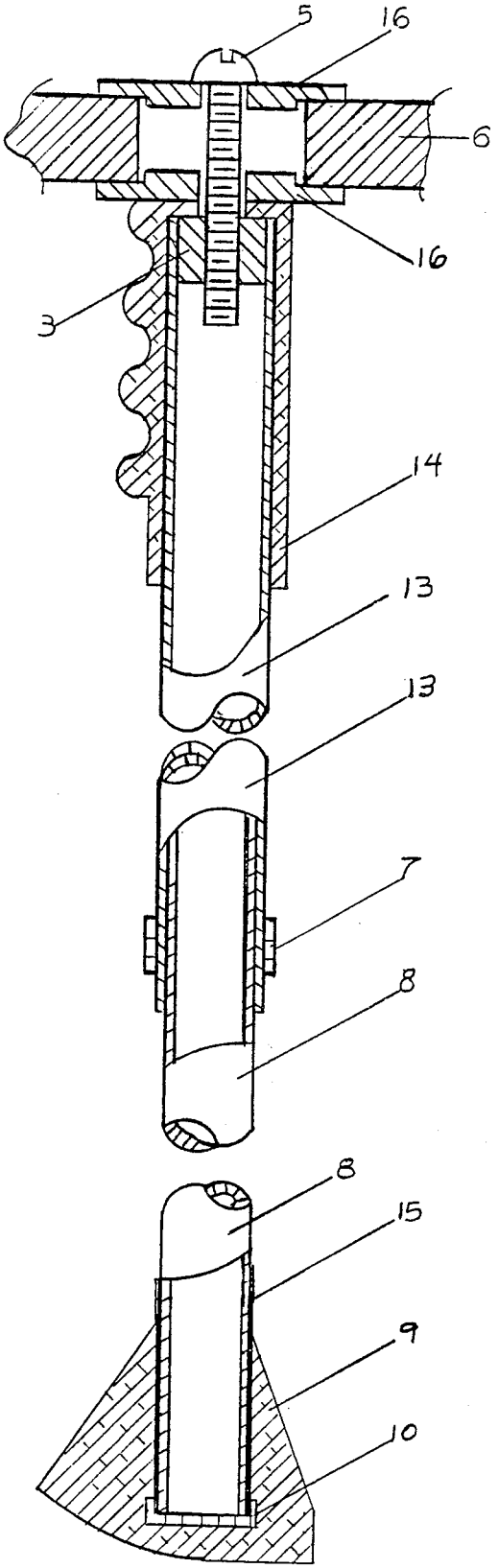
FIG 4
FIG 5
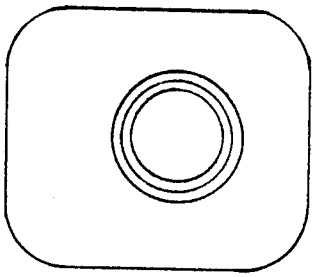

EXERCISE POLES

BACKGROUND OF THE INVENTION

1. Field of Invention

This invention used in pairs pertains to human body exercise, particularly conditioning development and improvement of upper body systems, organs, stature and muscles. It provides many of the exercise benefits of crosscountry skiing to walkers, joggers and runners and is used simultaneously with a regimen of these activities. Also, means are provided to change weight on it to require a controllable upward force during use to give a more balanced exercise routine. This device implements a total body concept of exercise when used in object manner.

2. Description of the Related Art

The benefits of cross-country skiing exercise are well known. Ski poles and their use provides many of these benefits but are limited in their use to the skiing environment. Only the skiers benefits and then only during the short skiing season and usually distant, costly skiing areas.

Additionally, cross-country skiing exercise machines have been developed and try to provide the same said benefits with limited success. These machines are comparatively large, heavy, and expensive. They are used by a small number of the public and benefit only these few.

Additionally, a hiking stick was shown in a recent outdoor catalog for use on hiking trails. The intended use of this stick is to help the user when hiking. The design offers little of the aforesaid skiing benefits.

OBJECTS OF THE INVENTION

The Exercise Poles invention are comparatively light weight and inexpensive. They can be used easily and readily almost at any time or place associated with walking. They will serve the large national community of walkers, joggers and runners. When they are used during these regimen, they will produce many exercise benefits similar to those of cross-country skiing and give total body exercise. Also, since these poles can be weighted and will then require a greater upward force of the arms and body during use they provide a more balanced and complete exercise routine. Also, the handgrip height is adjustable and provides for more efficient use of bodily forces and stature requirements.

SUMMARY OF THE INVENTION

The objects and advantages of the invention are described and claimed herein: to provide exercise poles to exercise, develop and improve the upper body systems, organs, stature, and muscles of walkers, joggers and runners and give total body exercise; to provide exercise poles that result in many of the benefits of cross-country skiing; to provide exercise poles which are comparatively light weight and inexpensive; to provide exercise poles which can be used easily and readily at almost any time or place used during walking exercise; to provide exercise poles which have adjustable handgrip height for more efficient use of bodily forces and stature requirements; to provide exercise poles which can be varied in weight to better meet user needs and provide a controllable amount of required upward force by the user producing a more balanced and complete exercise; to provide exercise poles which have changeable ground feet, and whose contact area will pivot with the poles and will maintain good ground coefficient of friction.

BRIEF DESCRIPTION OF THE DRAWINGS

FIG. 4 shows a section segmented view of another species.

FIG. 5 shows a top view of the foot.

DESCRIPTION OF PREFERRED EMBODIMENT

Making

Figure 1:
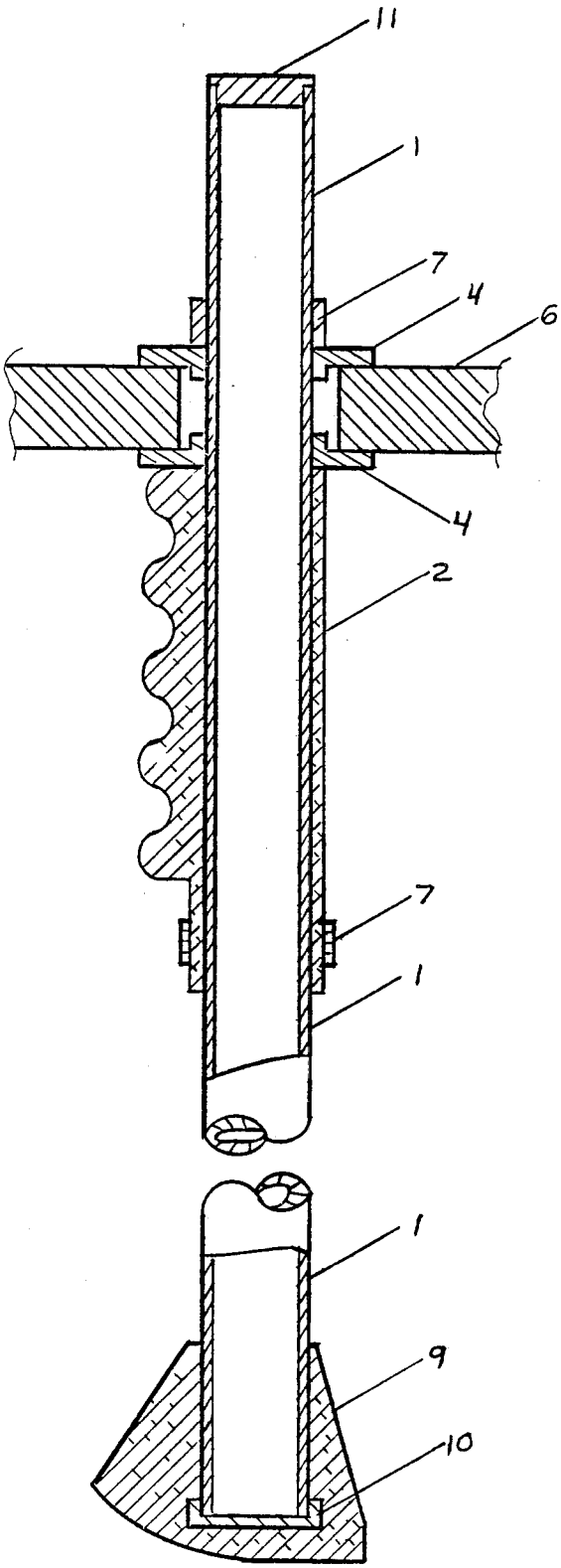
FIG. 1 shows a section segmented view of the preferred embodiment.
Figure 2:
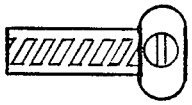
FIG. 2 shows sideview of the clamp 7.
Figure 3:
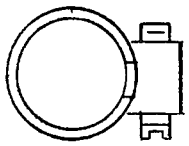
FIG. 3 shows top view of the clamp 7.

FIG. 1 shows the preferred embodiment of the invention. The device comprises a frame 1 about 1½ meters long and about 2 cm in diameter which has a handgrip 2 thereon. The said plastic handgrip 2 is about 12 cm long and is moveable along said frame 1 and is held in the desired position by tightening clamp 7 which is an ordinary screw adjustable hose clamp.

The foot 9 has a flat bottom portion, an arcuate forward portion and is hand pressed onto the said frame 1 and the buffer 10 is located at the inside bottom of said foot 9. FIG. 5 shows a top view of said foot 9 which is designed to maintain good ground adhesion during the rocking motion of the exercise poles when being used in the object manner. The weight means is comprised of two circular formed washers 4 about 4 cm in diameter and having about a 2.2 cm diameter centered hole. Said washers 4 fit over said frame 1 and slide down to the top of said handgrip 2. The weight 6 is a common bar bell disc weight having about a 2.54 cm hole in the center of it and is available in about 0.5 kgm to 5 kgm or heavier. Said weight 6 is held between said washers 4 and secured in place by another said clamp 7. A cap 11 is pressed into said frame at the upper end.

FIG. 4 shows another species of the invention. This device comprises a body 13 about one meter long and about 2 cm in diameter which has a plastic handle 14 mounted thereon. The said handle 14 is about 12 cm long and is handpressed onto the top of said body 13. The opposite end of said body 13 has 4 equal spaced longitudinal axial cuts about 3 cm long. At this area is located clamp 7 which surrounds said body 13 and is an ordinary screw adjustable hose clamp. The extension 8 is about 60 cm long and 1.6 cm diameter and slides into the bottom of said body 13 and held in place by tightening said clamp 7. A thin tubular spacer 15 is about 4 cm long and about 18 mm in diameter is tightly pressed onto the other end of said extension 8. The foot 9 is hand pressed onto the said spacer 15. The buffer 10 is at the inside bottom of said foot 9. The weight means is comprised of the stud base 3 pressure pressed into said body 13 and 2 disks 16 about 4 cm in diameter with a centered hole about 7 mm hold the weight 6 at its center and stud 5 is screwed down through the center of said disks 16 said weight 6 and said handle 14 into said stud base 3 thus securely holding the said weight 6 to said body 13.

The invention can be made in many different models: sizes for children to adults and giants; frame strength from light to heavy for required capability.

DETAILED DRAWING DESCRIPTION

Using

The devices of FIG. 1 and FIG. 4 are used in pairs and will implement a variety of exercise benefits. They provide many of the benefits of cross-country skiing to the community of walkers, joggers and runners, e.g.: cross-country walking. During use they emulate these motions. Additionally, when weighted they provide exercise to the upward force muscles of the hands, arms, shoulders and back giving a more balanced and complete exercise. Since the weights are selectable, a wide range of exertion requirements are possible and can be accommodated. The handgrip of the device can be adjusted to the height required by the user. In FIG. 1 loosen said handgrip clamp 7 and weight clamp 7, set handgrip to desired position and then retighten said clamps 7. In FIG. 4 loosen said clamp 7 and slide extension 8 in or out of said body 13 to produce the desired said handgrip 14 height and retighten said clamp 7. This will accommodate most stature height requirements. Additionally, the said handgrip can be set to the requirements of the user to control the amount of bend in the spine and muscles associated with forward leaning so as to work the various muscle groups of the back and exercise them as needed. Once the body gets used to one handgrip height it can be changed giving another or adjacent muscle group the main benefit. The exercise routine for some individuals could start with a less than ideal said handgrip 2 height and said weight 6 amount combination and gradually build towrd a more ideal setting as progress is noted and desired.

I see many other uses of said invention of different object such as physiotherapy for the back spine and upper body muscles. Also, since the poles provide good balance, they could be used to replace a cane in some cases. Also, they can provide added thrust and stability to the hiker. Also, they provide bettre human ventilation and breathing. The said device can also be used when standing still even then they will produce some exercise benefits when imitating a walking motion. Therefore, while a preferred embodiment and species of the invention has been shown and described, the invention is not to be limited thereto but only by the following claims.

I claim:

1. An exercise device, used in pairs, to simulate cross country skiing comprising:

a tubular frame having a bottom end and a top end, a handgrip means mounted on said frame and proximate the top end of said frame, a weight means removably mounted on the exterior of said frame proximate and above the handgrip means, a removable ground engaging means mounted on the bottom end of said frame and having a flat bottom portion and an arcuate forward portion, said arcuate portion providing a ground engaging pivot surface, and a height adjustment means whereby the distance between the handgrip means and the ground engaging means can be changed by axially sliding and securing the handgrip means and weight means on the frame.

2. The device of claim 1 wherein the weight means is comprised of a plate shaped barbell weight sandwiched between two flanges and mounting means secure the weight and flanges to the frame.

3. The device of claim 2 wherein the mounting means is comprised of a center hole in the weight and flanges and a clamp means whereby the weight and flanges are slid onto the top end of the frame and are clamped proximate the handgrip means by the clamp means.

4. The device of claim 3 wherein the height adjustment means is comprised of an additional clamp means below the handgrip means whereby the two clamp means are released and the handgrip means, weight and flanges are axially slid along the frame to a different position and then the clamp means are resecured.

5. The device of claim 2 wherein the weight is in the range of 0.5 to 5.0 kilograms.

6. An exercise device, used in pairs, to simulate cross country skiing comprising:

a tubular frame having a bottom end and a top end, a handgrip means mounted on the top end of said frame, a weight means removably mounted on the exterior of said frame proximate and above the handgrip means, a removable ground engaging means mounted on the bottom end of said frame and having a flat bottom portion and an arcuate forward portion, said arcuate portion providing a ground engaging pivot surface, and a height adjustment means whereby the distance between the handgrip means and the ground engaging means can be changed, said height adjustment means comprising the frame having an inner and outer tube telescopically engaged and locked together by a clamp means.

7. The device of claim 6 wherein the weight means is comprised of a plate shaped barbell weight sandwiched between two flanges and mounting means secure the weight and flanges to the frame.

8. The device of claim 7 wherein the mounting means is comprised of a center hole in the weight and flanges, a plug having a threaded inner bore rigidly mounted in the top end of the frame and a bolt wherein the bolt is placed through the weight and flanges and is threaded into the frame plug whereby the head of the bolt abuts the top flange and the bolt holds the weight and flanges to the top end of the frame.

9. The device of claim 7 wherein the weight is in the range of 0.5 to 5.0 kilograms.

* * * * *